US006224106B1

(12) United States Patent
Murphy

(10) Patent No.: US 6,224,106 B1
(45) Date of Patent: May 1, 2001

(54) BOOK WITH NESTED SCULPTED FORMS

(76) Inventor: Charles Murphy, 13349 Friar St., Van Nuys, CA (US) 91401

( * ) Notice: Subject to any disclaimer, the term of this patent is extended or adjusted under 35 U.S.C. 154(b) by 0 days.

(21) Appl. No.: 08/949,292

(22) Filed: Oct. 13, 1997

(51) Int. Cl.[7] ..... B42D 1/00; B42D 15/00

(52) U.S. Cl. ..... 281/15.1; 281/38; 281/20; 283/63.1; 283/17; 434/269

(58) Field of Search ..... 434/269; 206/457; 281/20, 15.1, 38; 283/17, 117, 63.1; 40/800, 1

(56) References Cited

U.S. PATENT DOCUMENTS

| | | | | |
|---|---|---|---|---|
| 396,381 | * | 6/1889 | Yaggy | 434/269 |
| 421,833 | * | 2/1890 | Henckel | 434/269 |
| 1,141,480 | * | 6/1915 | Murayama | 434/269 |
| 1,405,134 | * | 1/1922 | Hoyme . | |
| 2,489,240 | * | 2/1949 | Meyer . | |
| 2,544,783 | | 3/1951 | Freedman et al. . | |
| 3,137,080 | * | 6/1964 | Zang | 40/800 |
| 3,471,962 | | 10/1969 | Klein . | |
| 3,982,574 | | 9/1976 | Edmudo et al. . | |
| 4,176,473 | | 12/1979 | Rae . | |
| 4,408,643 | | 10/1983 | Louis et al. . | |
| 4,490,123 | * | 12/1984 | Becker et al. | 446/204 |
| 5,031,935 | * | 7/1991 | D'Andrea | 281/15.1 |
| 5,050,910 | * | 9/1991 | Schechter et al. | 283/105 |
| 5,178,542 | * | 1/1993 | Chigrinsky et al. | 434/157 |
| 5,199,602 | | 4/1993 | Terrence . | |
| 5,590,909 | * | 1/1997 | Urban et al. | 280/20 |
| 5,695,295 | * | 12/1997 | Ayele et al. | 402/80 |
| 5,788,286 | * | 8/1998 | Hunt | 283/117 |
| 5,803,501 | * | 9/1998 | Gluck | 283/75 |
| 5,806,223 | * | 9/1998 | Visagie | 40/160 |

FOREIGN PATENT DOCUMENTS 2267951 11/1975 (FR) .

* cited by examiner

*Primary Examiner*—Willmon Fridie, Jr.
*Assistant Examiner*—Alisa L Thurston
(74) *Attorney, Agent, or Firm*—Ira M. Siegel

(57) ABSTRACT

The invention is a book which comprises a series of sculpted figures which nest within each other. The sculpted figures are preferably made of vacuum formed plastic, in a manner similar to that used in making the plastic shells for a blister package. In preferred embodiment, the figures are affixed to the basic portion of the pages of the book, with the portion of the base which lies within the perimeter of the figures removed. The remainder of each page may have text or graphics disposed on it. The figures are formed so that the figures or the lower pages nest within the figures on the upper pages. The figures will usually have graphics printed on them. However, some or all of them may be at least partially clear, and some or all of them may have text disposed on them.

10 Claims, 9 Drawing Sheets

BOOK WITH NESTED SCULPTED FORMS

FIELD OF INVENTION

The present invention relates to the field of illustrated books.

BACKGROUND OF THE INVENTION

The purpose of the present invention is to provide a book which presents depictions of three dimensional objects in an educational and/or entertaining way. The prior art, of course, has accomplished this goal by several different means, none of which is as elegant or effective as the present invention.

One prior art system which is often seen is the "pop-up" book. In this system, as a book is opened to a particular page, one or more figures spring upward from that page as a result of the natural rigidity of the material from which the figures are made and the cuts and folds disposed in the figures. When that particular page is turned, the figures fold flat and new figures on the next page spring upward. An example of a pop-up book is shown in U.S. Pat. No. 2,544,783 issued to William B. Freedman, et al.

Another book system for depicting three dimensional objects is shown in U.S. Pat. No. 4,176,473 issued to Donald A. Rae. In the Rae system, the book comprises a plurality of thin, flat pages each having a peripheral frame which combine to hold one or more molded figurines. The frame extends outward from the front and back surfaces of the page and has a thickness on each side which is at least one-half the thickness of the figurines. The thin, flat portion of the page has a cut out portion which conforms in size and shape to the profile of the figurine it is adapted to receive. The figurine is removably engaged within the cut out by friction. The flat portion of the page must be made of a stiff material, as must the frame. In another embodiment, Rae teaches that the pages may be made without a border, provided that each page is made at least as thick as the figurine. A space for the figurine is dug out from the thick page. In still another embodiment, the individual pages may be thin, but successive pages, having a total thickness equal to the thickness of the figurine, have cut outs to accommodate the figurine. No matter which embodiment is used, the Rae book is very thick and can hold only a relatively few figurines.

The prior art also includes books having multiple pages, all or part of each page formed of clear, flat plastic printed with graphics illustrating cross-sectional views of various subjects.

SUMMARY OF THE INVENTION

The invention is a book which comprises a series of sculpted figures which nest within each other. The sculpted figures are preferably made of vacuum formed plastic, in a manner similar to that used in making the plastic shells for a blister package. In preferred embodiment, the figures are affixed to the base portion of the pages of the book, with the portion of the base which lies within the perimeter of the figures removed. The remainder of each page may have text or graphics disposed on it. The figures are formed so that the figures or the lower pages nest within the figures on the upper pages. The figures will usually have graphics printed on them. However, some or all of them may be at least partially clear, and some or all of them may have text disposed on them.

The present invention may be used as an instruction manual, a children's book or any type of book where multiple three-dimensional depictions are desired.

None of the prior art can be used to illustrate three dimensional figures. as dynamically as can the present invention. By way of example, the Rae book can provide a figurine depicting a dinosaur. The instant invention can show (i) the dinosaur when the book is turned to the first page; (ii) the circulatory system of the dinosaur when the book is turned to its second page, and (iii) the skeletal system of the dinosaur when the book is turned to its third page, all in three-dimensional form.

In a similar manner, a three dimensional depiction of, for example, a part of an automobile engine may be shown in a repair manual. As the pages of the manual are turned, the exterior coverings and other parts are "removed" thereby providing a technician with step by step illustrations in three-dimensional form, of how to get to a defective part.

For history buffs, the site of a historical landmark can be shown as it likely appeared at various stages of history, with each page depicting a different era. For example, the fort in San Antonio, Tex. can be shown at the various stages of the famous Battle of the Alamo.

Clearly, there are many uses for the present invention which cannot be attained with prior art devices. Such uses are coextensive with the creativity of artists and writers who use the invention.

DETAILED DESCRIPTION OF THE INVENTION

Figure 1:
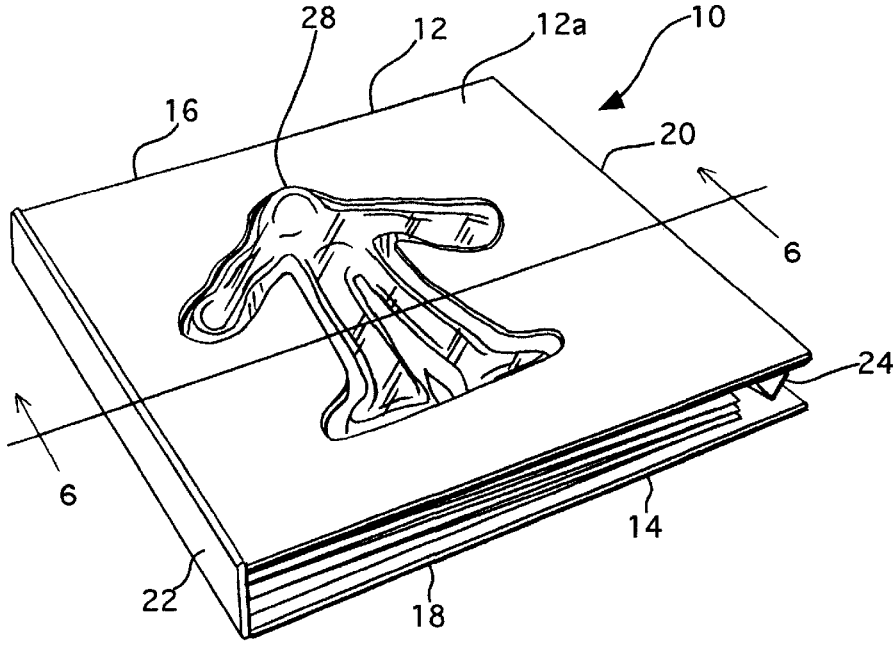
FIG. 1 is a perspective view of one embodiment of the book of the present invention in a closed position.

The preferred embodiments of the invention are illustrated in FIGS. 1–15. Identical parts are designated by the same reference numerals throughout the drawings.

Figure 5:
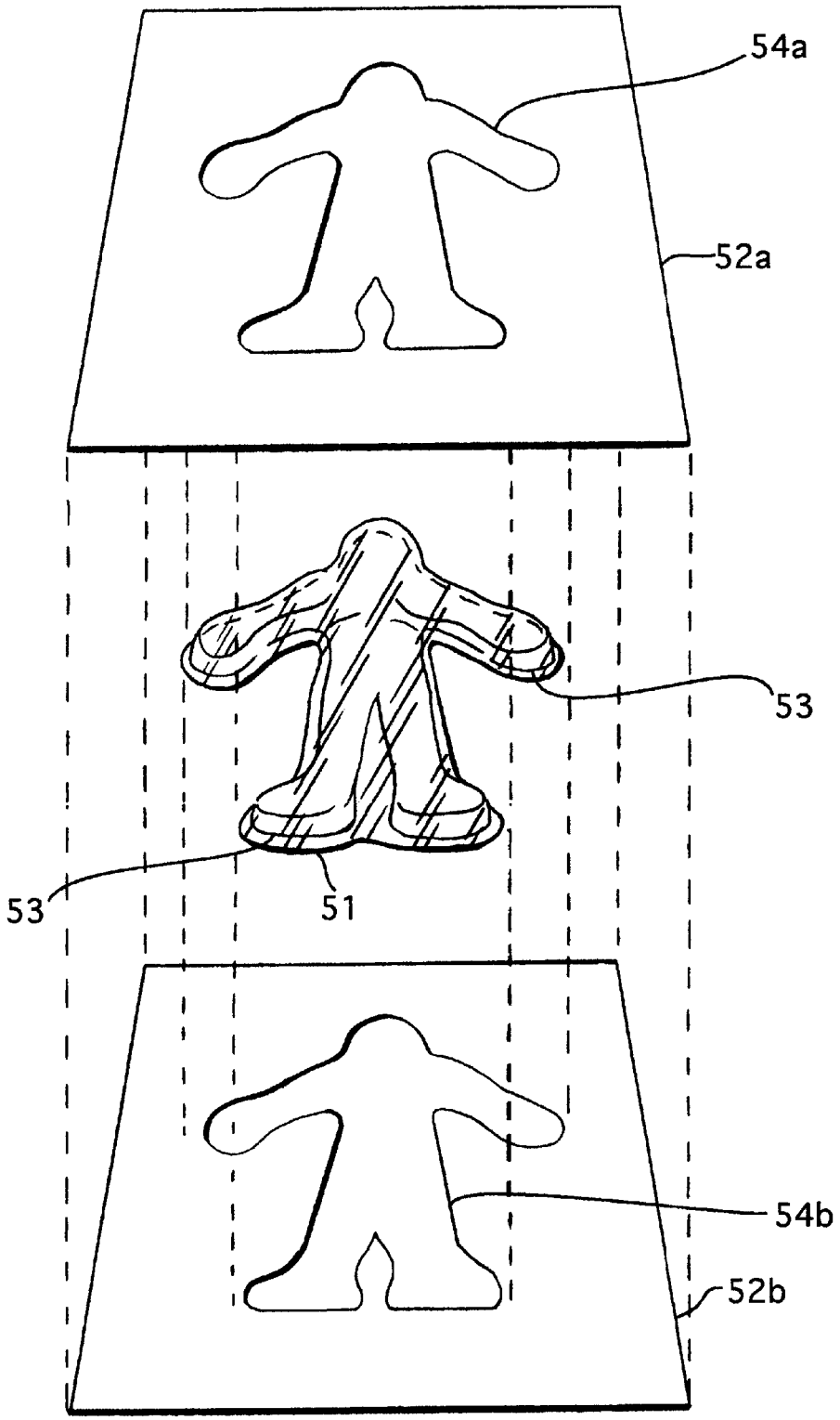
FIG. 5 is an exploded view of a page of a book of the present invention, showing the elements of such a page.
Figure 6:
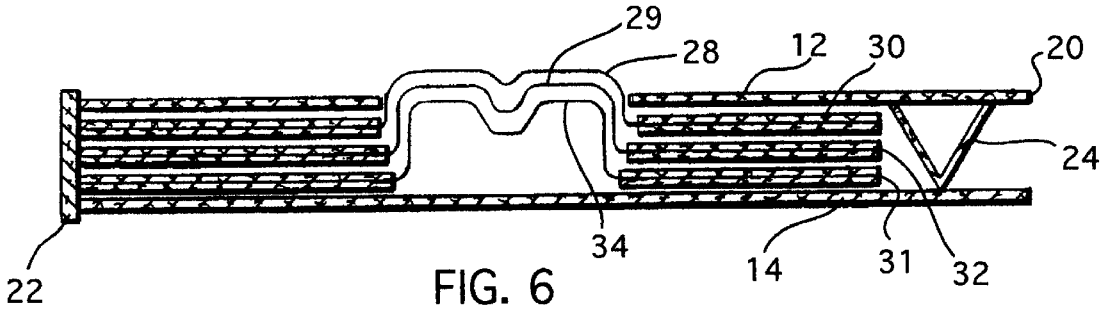
FIG. 6 is a bottom cross-sectional view of the book of the present invention taken along line 6—6 of FIG. 1.
Figure 7:
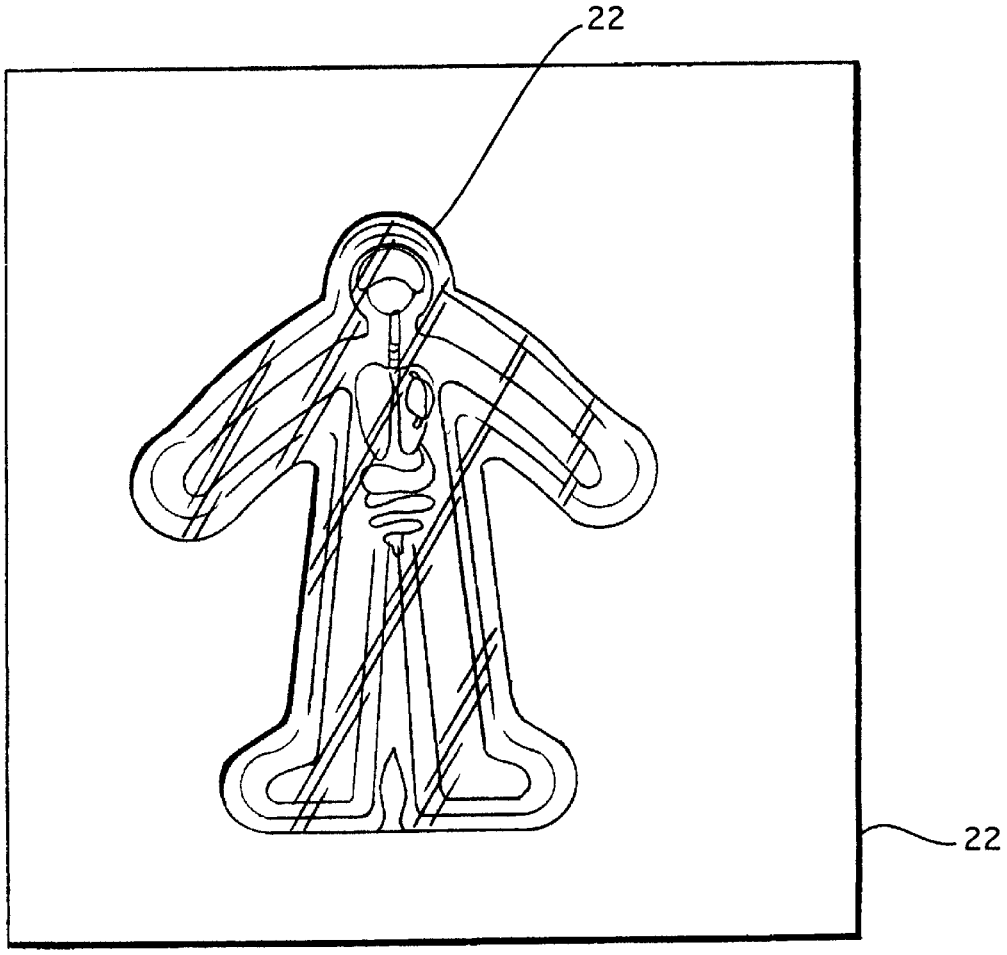
FIG. 7 is a front plan view of a typical page of a book of the present invention, in this case illustrating the heart, pulmonary and digestive system of a human.
Figure 7A:
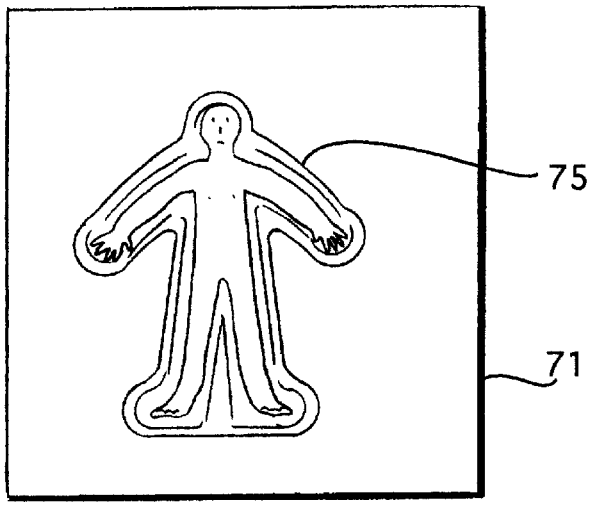
FIGS. 7A, 7B and 7C are front plan views of a typical three page series of a book of the present invention, in this case with the page of FIG. 7A illustrating a normal front view of a human, the page of FIG. 7B showing the heart, pulmonary and digestive system of a human and FIG. 7C showing the skeletal system of a human.
Figure 7B:
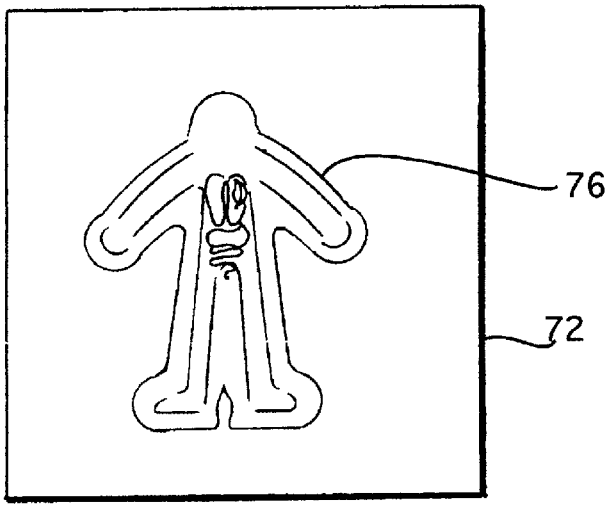
Figure 7C:
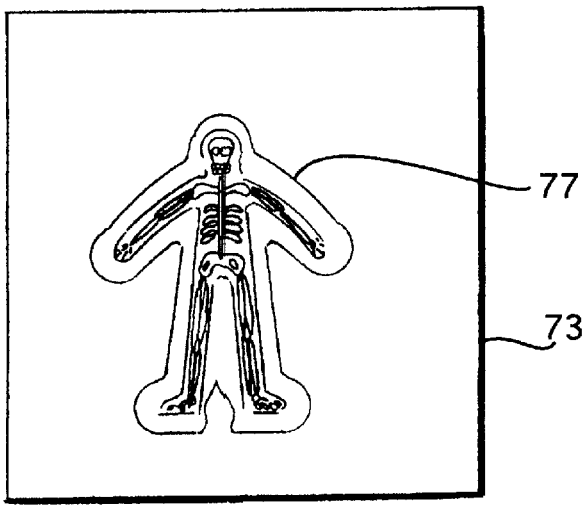

A first embodiment of the invented book 10 is shown in FIGS. 1–7 (including FIGS. 7A–7C). The book of the present invention includes a front cover 12 and a back cover 14. Using directions conventionally used when referring to books, the book of the present invention has a top 16, a bottom 18, a right side 20 and a left side 22. The left side 22 also forms the spine of the book. The book includes a plurality of pages such as pages 30, 31 and 32 which include raised three dimensional FIGS. 28, 29 and 34, respectively. The raised three dimensional figures are formed to generally conform to the shape of the object being illustrated by the book; by way of example, a dinosaur, a fort, an engine or, as shown in the drawings, a human.

The book of the present invention also includes a cover stop 24 which is preferably affixed along an interior side of either the front or back cover which is opposite to the spine of the book. In the example of the invention shown on the drawings, the stop is affixed along the right side of the inside surface 12*b* of the front cover. Note that the stop may be disposed along the top and/or bottom sides of either cover, or along a portion of any of the sides of the book. The purpose of the stop is to prevent the front and back covers from being squeezed so tightly together such that crushing pressure is brought to bear on the figures.

In the first embodiment the cover has a hole (or cut-out) 26 formed in it which conforms to the perimeter of the raised three dimensional FIG. 28 on the first page of the book. The purpose of the cut-out is to allow for display of not only the outside surface 12*a* of the front cover of the book, but also for a "see me, feel me" display of at least the first raised three dimensional figure, which would be an interesting feature to a purchaser of the book.

Figure 2:
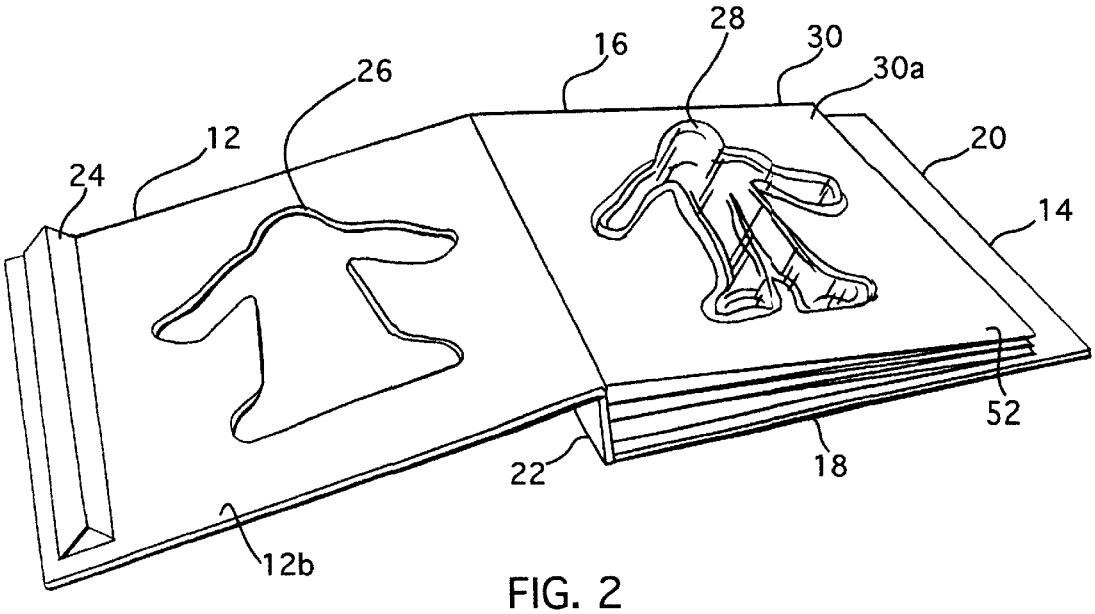
FIG. 2 is a perspective view of the first embodiment the book of the present invention with its front cover in an open position and the front of the first page visible to the reader of the book.
Figure 3:
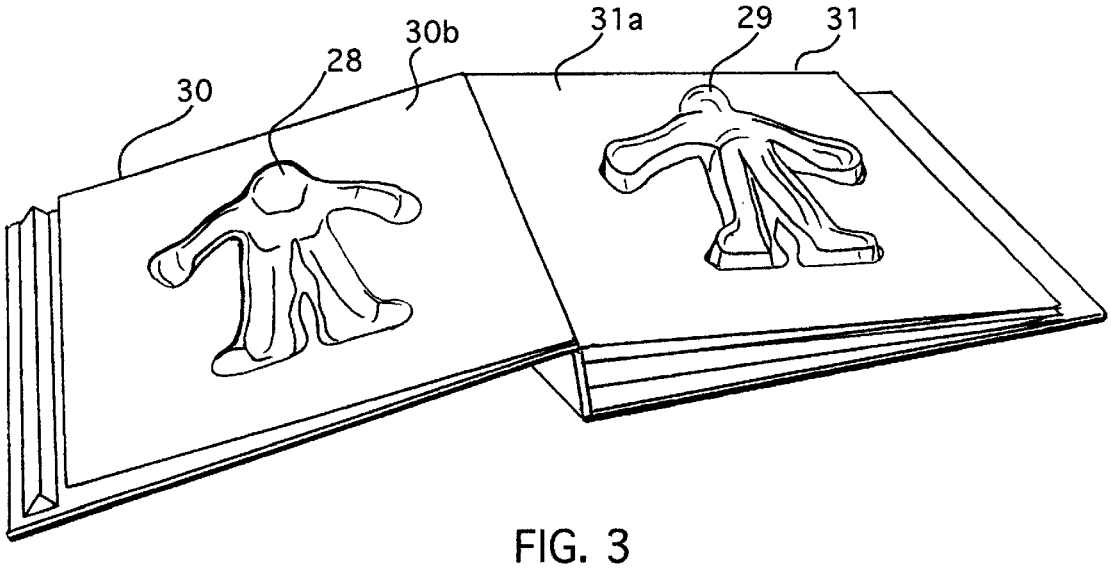
FIG. 3 is a perspective view of first embodiment of the book of the present invention with the first page turned and the rear of the first page and the front of the second page visible to the reader of the book.
Figure 4:
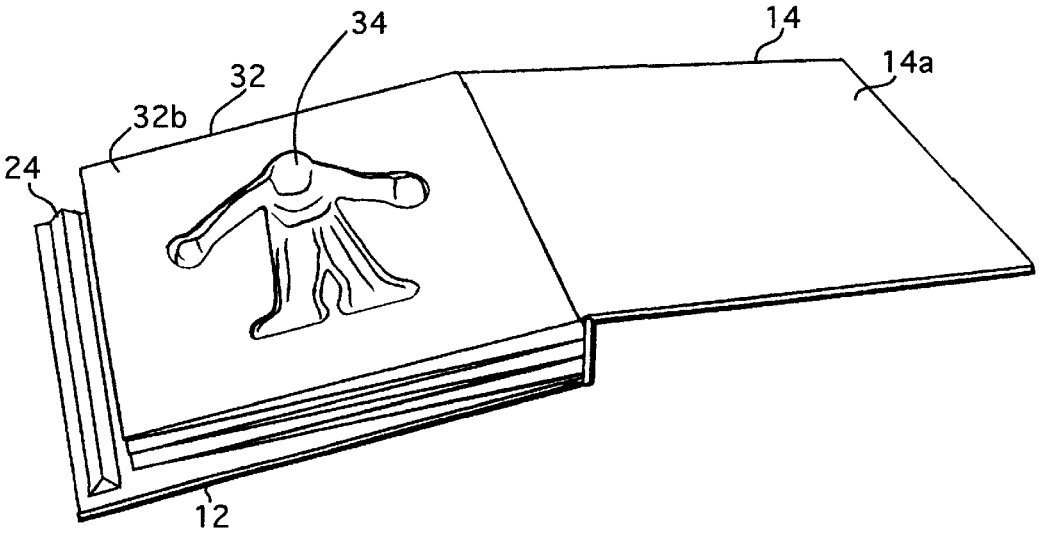

FIGS. 1 and 6 show the book of the present invention in a closed position. FIG. 2 shows the book of the present invention with the cover in the open position with the inside surface 12*b* of front surface 30*a* visible to a reader of the book. FIG. 3 shows the book of the present invention with the first page of the book turned, with the rear surface 30*b* of the first page 30 and the front surface 31*a* of the second page visible to a reader. FIG. 4 shows the book of the present invention with the last page (here page 32) turned with the rear surface 32*b* of the last page and the inside surface 14*a* of the back cover visible to the reader of the book. Graphics or text or both may be printed on any surface of the book, including the inside and outside surfaces of the front and back covers and the front and rear surfaces of the pages, including the front and rear surfaces of the raised three dimensional figures.

The pages are pivotally secured to the spine of the book in any manner known in the book publishing field. Also, in this regard, the pages may be removably pivotally secured to the spine by means of rings, posts, spiral wire, snap fasteners, Velcro® hook and loop fasteners, magnetic fasteners or the like, used for example in loose leaf books, photo albums, spiral notebooks. The cover of the book may be formed of paper, card board, plastic or any material known to be useful for forming book covers. In the preferred embodiments of the invention, the cover (i.e., the front and back covers) and the spine are formed of a relatively stiff material so that, in conjunction with stop 24, the cover when it is closed, prevents outside pressure (e.g., from other books being placed on it) from being transferred to the three dimensional forms and crushing them.

Each of the pages of the book may be formed entirely of the same material which forms the raised three dimensional figure portion of the page. The raised three dimensional figure is preferably fabricated from vacuum-formed plastic in a manner similar to that used in making plastic shells for blister packages for retail packaging of products. The material should be clear and be capable of being printing on.

In the preferred embodiment, however, each page is formed of two materials; vacuum-formed plastic for the raised three dimensional figure portion of the page and paper for the remainder of the page. With reference to FIG. 5, raised three dimensional FIG. 28 is seen to have a peripheral flange 51 which extends out from the border 53 of the raised three dimensional figure in the same plane as the portion of the page which is not raised (i.e., the base of the page 52 (see FIG. 2)). The base of the page is formed by two identically sized sheets 52*a* and 52*b* of paper, each of which has a cut-out 54*a* and 54*b* which is sized and shaped to align substantially identically with the border of the raised three dimensional figure. The page is formed by fitting the raised three dimensional figure into the cut-out 54*a* in upper sheet 52*a* so that the flange abuts against the underside of that sheet and then fixedly securing the upper side of the lower sheet 52*b* to the underside of the upper sheet. The raised three dimensional figure is trapped between the two sheets by virtue of the flange 51. In the preferred embodiment, the upper and lower sheets are adhesively bound together by placing an adhesive on the entire underside of the upper sheet or on the entire upper side of the lower sheet, or on both. This way, the raised three dimensional figure will be adhesively bound to the paper base of the page.

Forming the page this way serves two functions. One is the saving of money because paper and adhesive is less expensive than plastic. The other is that this method creates a nicer presentation.

The raised three dimensional figures are sized and shaped so that the raised three dimensional figure of the second page nests within the raised three dimensional figure of the first page. Similarly, the raised three dimensional figure of each successive page of the book is sized and shaped to nest into the raised three dimensional figure of the immediately preceding page. See, for example, FIG. 6, where raised three dimensional FIG. 34 is sized and shaped so as to nest within raised three dimensional FIG. 29, which is sized and shaped so as to nest within raised three dimensional FIG. 28.

With reference to FIGS. 7, 7A, 7B and 7C, one of the beneficial features of the present invention can be described. The raised three dimensional figures on each of pages 71 (shown in FIG. 7A), 72 (shown in FIGS. 7 and 7B) and 73 (shown in FIG. 7C), bear graphics illustrating different parts of the human anatomy. Raised three dimensional FIG. 75 of page 71 illustrates the outer covering (e.g., skin) of a human; raised three dimensional FIG. 76 of page 72, which follows page 71, illustrates the heart and the pulmonary and digestive system of a human; and raised three dimensional FIG.

77 of page 73 which follows page 72, illustrates the human skeletal system. Other graphic and text material may appear on the pages (and as indicated above, on both surfaces of the pages, including the front and rear surfaces of the raised three dimensional figures). The reader, upon turning pages 71 and 72, can clearly see the many individual parts of the human anatomy illustrated on the different levels of the raised three dimensional figures, and their spatial relationship to each other.

Of course, the raised three dimensional figure depicting other things besides humans can be used. As discussed in the Summary of the Invention section of this specification, various levels of an engine could be illustrated or various stages of a battle could be depicted. The uses of the present invention are as varied as the talents of writers and illustrators who would use the invention.

Figure 8:
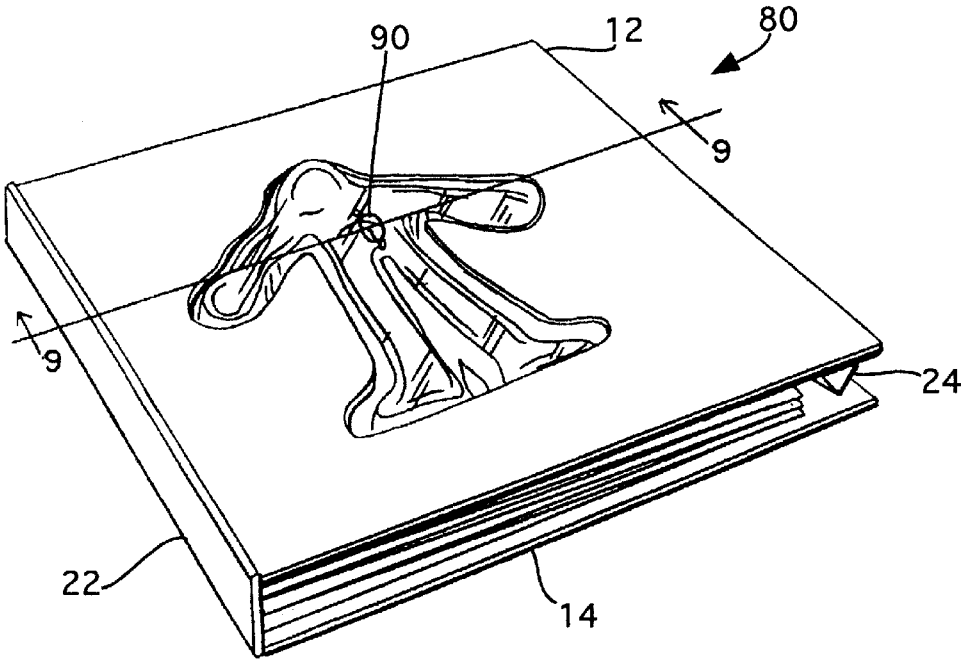
FIG. 8 is a perspective view of a second embodiment of the book of the present invention in a closed position.
Figure 9:
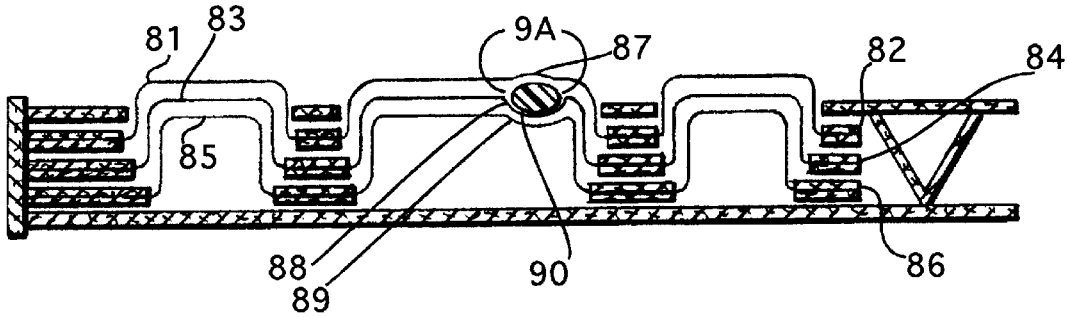
FIG. 9 is a bottom cross-sectional view of the second embodiment of the book of the present invention taken along line 9—9 of FIG. 8.

FIGS. 8 and 9 illustrate a second embodiment of the invention. It is substantially the same as the embodiment illustrated in FIGS. 1–7 (including FIGS. 7A, 7B and 7C), except that the raised three dimensional FIG. 81 of page 82 has a slight protuberance 87 and the raised three dimensional FIGS. 83 and 85 of pages 84 and 86 respectively, have slight depressions 88 and 89 so that a cavity is formed between pages 82 and 83 to receive a separate figurine 90, in this example a figurine of a human heart. The figurine may be loosely trapped in the cavity, so that a reader may closely examine a model of that organ. Preferably, the figurine is removably adhered to the raised three dimensional figure of page 84.

Figure 9A:
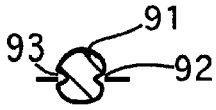
FIG. 9A is a bottom cross-sectional view of a portion of the invention depicted in FIG. 9 at lines 9A, indicating an alternate embodiment thereof.

In FIG. 9A an alternate version of the second embodiment of the present invention is illustrated. In this version, the raised three dimensional figure has a hole formed in it with a rim which fits into a groove 93 formed in figurine 91. With such a construction, the figurine may be removably snap-fitted into a raised three dimensional figure.

Figure 10:
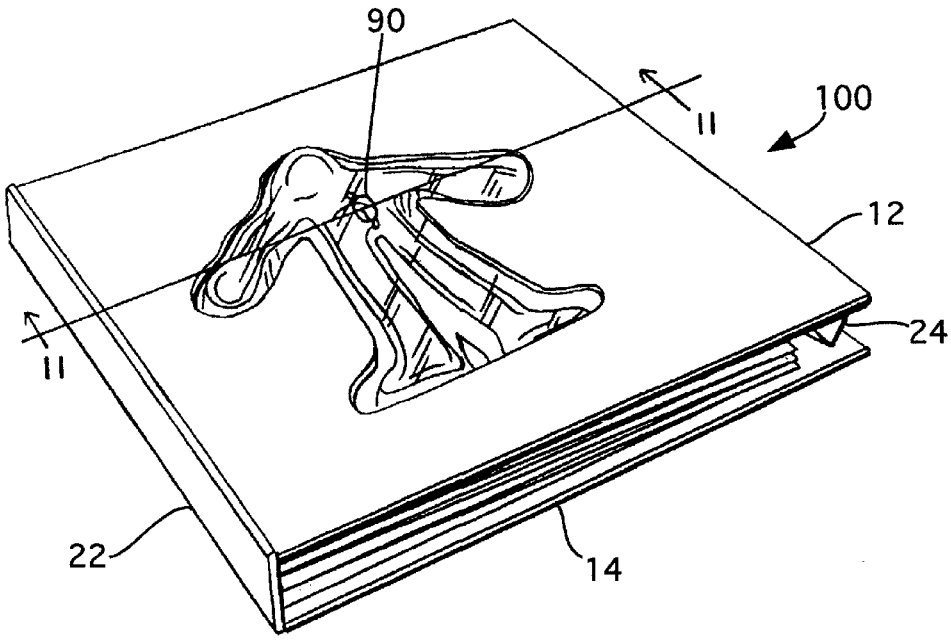
FIG. 10 is a perspective view of a third embodiment of the book of the present invention in a closed position.
Figure 11:
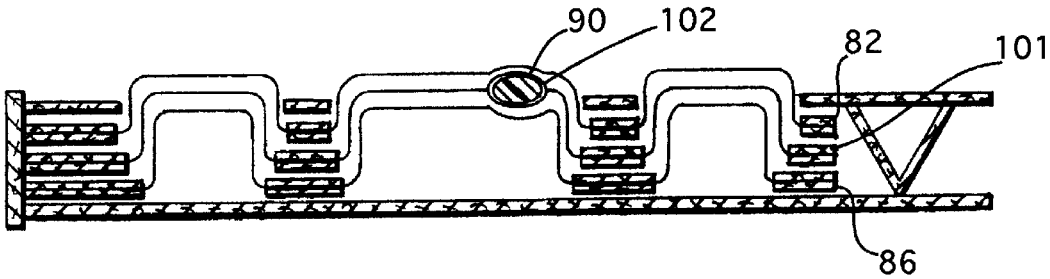
FIG. 11 is a bottom cross-sectional view of the third embodiment of the present invention, taken along lines 11—11 of FIG. 10.

FIGS. 10 and 11 illustrate a third embodiment of the book of the present invention. It is identical to the embodiment of FIGS. 8 and 9, except the raised three dimensional figure of page 101 is formed with a pocket 102 into which the figurine 90 is fitted.

Figure 12:
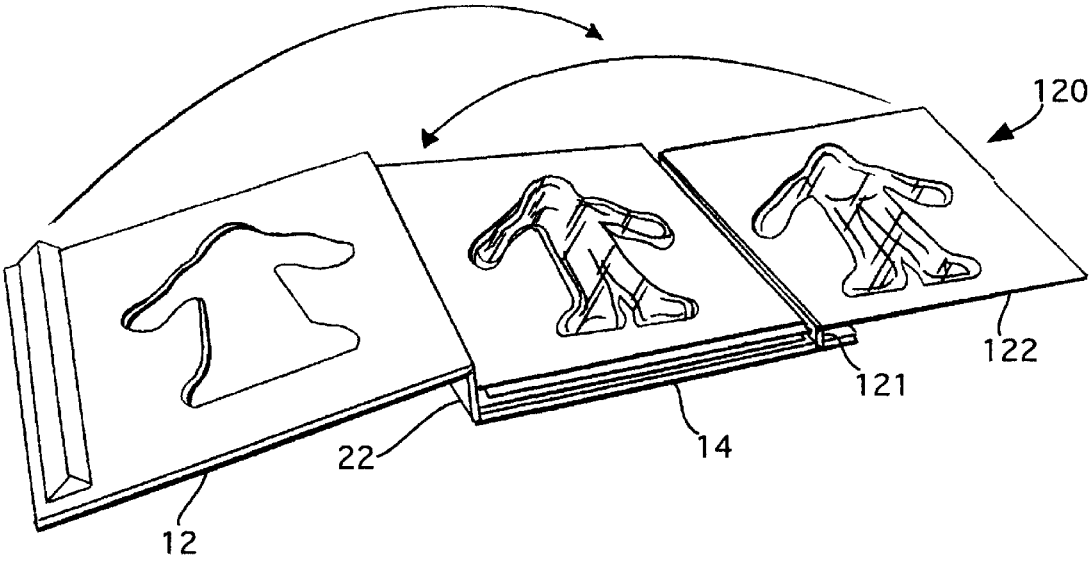
FIG. 12 is a perspective view of a fourth embodiment of the book of the present invention in an open position.
Figure 13:
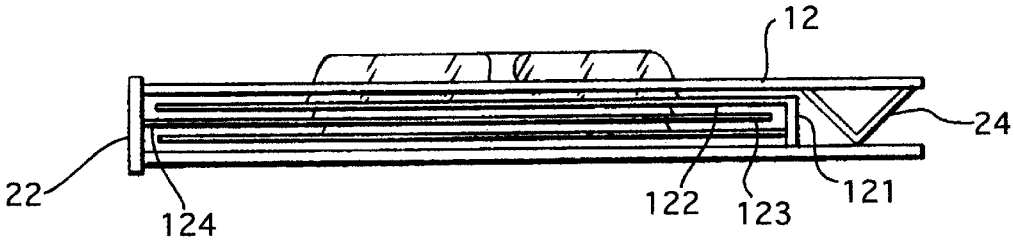
FIG. 13 is a bottom plan view of the fourth embodiment of the book of the present invention in a closed position.

FIGS. 12 and 13 illustrate a fourth embodiment 120 of the book of the present invention. It is the same as the embodiment shown in FIGS. 1–7 (including FIGS. 7A, 7B and 7C), except that the book includes a second spine 121 upstanding from the inside surface 14*a* of the back cover. Pages 122 and 123 are pivotally bound to spine 121 and, like page 124, which is bound to first spine 22, each includes a raised three dimensional figure. The pages which are bound along their left edge are interleaved with the pages bound along their right edge for quicker turning of pages. Also, either of two different raised three dimensional figures can be brought into immediate overlay with respect to a third raised three dimensional figure. For example, if the book of the present invention were a fashion guide, the raised three dimensional figure on page 122 could depict a model wearing a red skirt and the raised three dimensional figure on page 124 could depict a model wearing a black skirt, each of which may be separately laid over the raised three dimensional figure on page 123 which may depict a model wearing a white blouse. (Note, in some versions of the embodiment shown in FIGS. 12 and 13, stop 24 may be dispensed with because of the presence of spine 121.)

Figure 14:
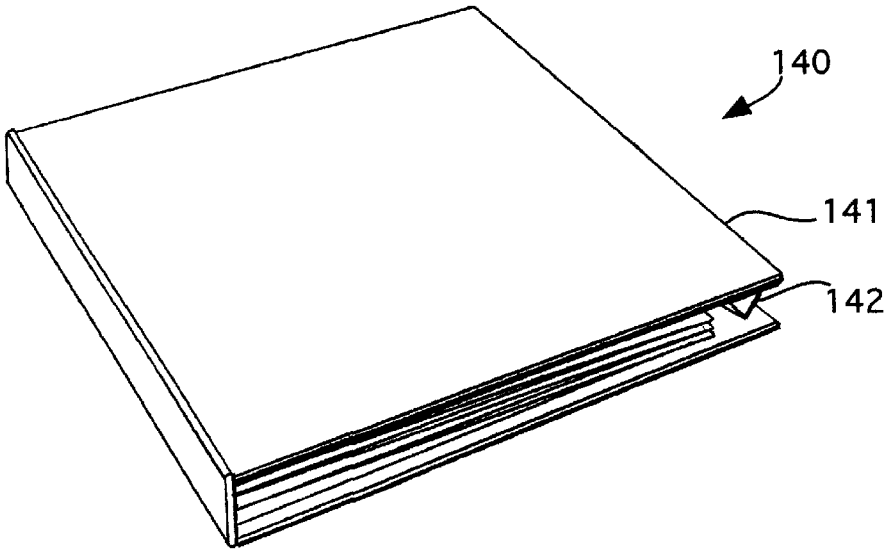
FIG. 14 is a perspective view of a fifth embodiment of the book of the present invention in a closed position.
Figure 15:
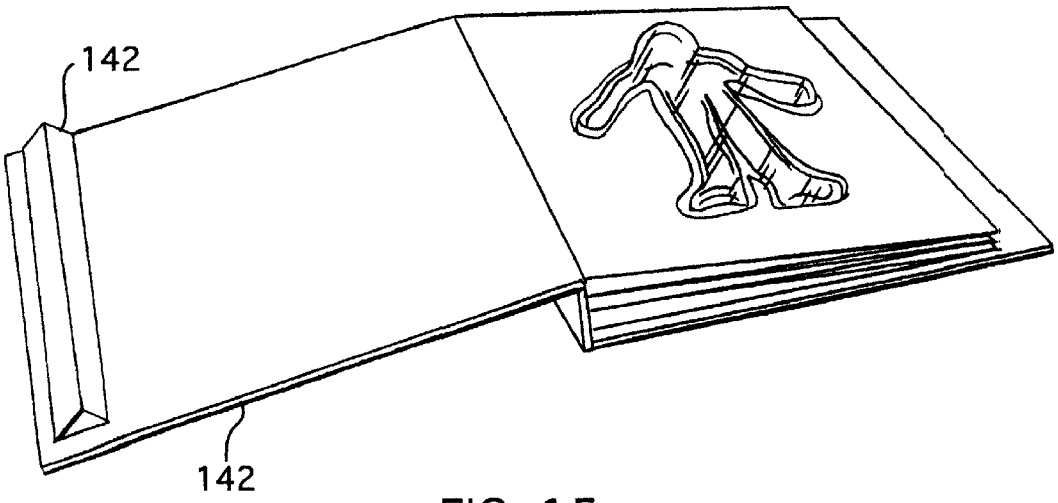
FIG. 15 is a perspective view of the fifth embodiment of the book of the present invention with its front cover in an open position and the front of the first page visible to the reader of the book.

FIGS. 14 and 15 illustrate a fifth embodiment 140 of the book of the present invention. It is the same as the embodiments shown in FIGS. 1–7 (including FIGS. 7A, 7B and 7C), except that front cover 141 does not have a cut-out and cover stop 142 has a bit more height than cover stop 24 to provide protection against compressing the uppermost raised three dimensional figure.

A unique book has been described above. It will be understood that various changes of the details, materials, steps, arrangements of parts and uses which have been herein described and illustrated in order to explain the nature of the invention will occur to and may be made by those skilled in the art, and such changes are intended to be included within the scope of my invention.

Several examples have already been described above. By way of another example, a book of the present invention may have a plurality of pages, each of which includes a raised three dimensional figure, plus additional pages which do not include raised three dimensional figures. Such additional pages may have cut-outs to accommodate raised three dimensional figures from subsequent pages or they maybe solid, conventional pages. In the latter case, the solid pages would likely be positioned at the front or back of the book, or in both places.

By way of another example, the book may comprise a plurality of pages having depressed three dimensional figures. Since such depressed three dimensional figures would really be raised three dimensional figures oriented toward the back of the book rather than the front of the book, it will be understood that such depressed three dimensional figures are the same as raised three dimensional figures.

By way of another example, separate multiple raised three dimensional figures may be disposed on the pages.

By way of another example, the pages of the book may be formed in fold out fashion.

By way of another example, the pages of the book may be formed and bound in what is known in the trade as concertina or accordion binding.

By way of still another example, spines may be disposed along the top and/or bottom edges of the book and pages bearing raised three dimensional figures may be pivotally bound to them as well.

I claim:

1. A book comprising a plurality of pages each of which includes a base and a raised three dimensional figure rising from said base, and wherein the raised three dimensional figure on one page nests within the raised three dimensional figure of a page disposed above it.

2. The book of claim 1, each said raised three dimensional figure having a border.

3. The book of claim 2, the base of each of said plurality of pages having a hole formed in it with a perimeter which corresponds to the border of the raised three dimensional figure of that page.

4. The book of claim 3 wherein each said raised three dimensional figure has a peripheral flange extending out from said border.

5. The book of claim 4 wherein the base of each of said plurality of pages is formed of a first sheet and a second sheet, each sheet having said hole formed in it, with said flange of said raised three dimensional figure trapped between said first and second sheet.

6. The book of claim 5 wherein the flange is bonded to at least one of said first and second sheets.

7. The book of claim 6, further including a front and back cover, a spine to which said plurality of pages are pivotally attached, and a cover stop attached to at least one of said front and back covers, which cover stop prevents said front and back covers from being squeezed together so as to damage said raised three dimensional figures.

8. The book of claim 7 wherein said spine is a first spine and wherein said book includes a second spine to which some of said plurality of pages are pivotally attached.

9. The book of claim 6 wherein said raised three dimensional figures are formed of vacuum-formed plastic.

10. The book of claim 9 wherein said bases are formed of paper.

* * * * *